US005460203A

United States Patent [19]

Smith et al.

[11] Patent Number: 5,460,203

[45] Date of Patent: Oct. 24, 1995

[54] AIR VALVE

[75] Inventor: Rowland C. Smith, Wimborne, Anthony JoBate, Winton, both ofUnited Kingdom

[73] Assignee: ITW Limited, United Kingdom

[21] Appl. No.: 256,160

[22] PCT Filed: Jan. 12, 1993

[86] PCT No.: PCT/GB93/00057

§ 371 Date: Jun. 23, 1994

§ 102(e) Date: Jun. 23, 1994

[87] PCT Pub. No.: WO93/13869

PCT Pub. Date: Jul. 22, 1993

[30] Foreign Application Priority Data

Jan. 13, 1992 [GB] United Kingdom ..... 9200605

[51] Int. Cl.[6] ..... B05B 7/12

[52] U.S. Cl. ..... 137/630.22; 239/407; 239/528

[58] Field of Search ..... 137/630.19, 630.22; 239/407, 412, 528

[56] References Cited

U.S. PATENT DOCUMENTS 3,327,949 6/1967 Eull ..... 239/412

5,284,299 2/1994 Medlock ..... 239/412 X

FOREIGN PATENT DOCUMENTS 0381072 8/1990 European Pat. Off. .

1306927 2/1973 United Kingdom .

WO91/03320 3/1991 WIPO .

*Primary Examiner*—Robert G. Nilson

*Attorney, Agent, or Firm*—MacMillan, Sobanski & Todd

[57] ABSTRACT

A trigger operated air valve suitable for controlling both the flow of air to and the flow of feedback air from a nozzle assembly in high volume low pressure (HVLP) spray guns. A trigger moves a spindle against the pressure of a spring. As the trigger is moved, a first valve is opened to initiate a main flow of air to the spray gun nozzle assembly prior to opening a second valve which initiates the flow of feedback air from the nozzle assembly. When the trigger is released, the second valve is closed to terminate the flow of feedback air prior to closing the first valve to terminate the main flow of air to the spray gun nozzle assembly.

9 Claims, 2 Drawing Sheets

AIR VALVE

This invention relates to an air valve more particularly for controlling the feedback air in HVLP spray guns.

An aim of the present invention is to shut off the feedback line when the spraygun is in the Off position.

According to the present invention there is provided an air valve for controlling the feedback air in spray guns comprising a valve body and a fixed valve member, a spindle slidable and sealingly passing through the valve body and valve member, the spindle having a shoulder engaging and closing a first seating in the valve member the rear of the spindle slidable in a shuttle which is itself slidable in a fixed valve spool, the spool having a second seating closed by the rear of the shuttle wherein two ports are provided one at either side of the second seating between the spool and shuttle for the passage of feedback air past the valve and two further ports are provided one at either side of the first seating between the valve member and spindle shoulder for the passage of main air through the valve so that operation of the spindle opens the first seating prior to the second seating and closes the second seating prior to the first seating.

Figure 1:
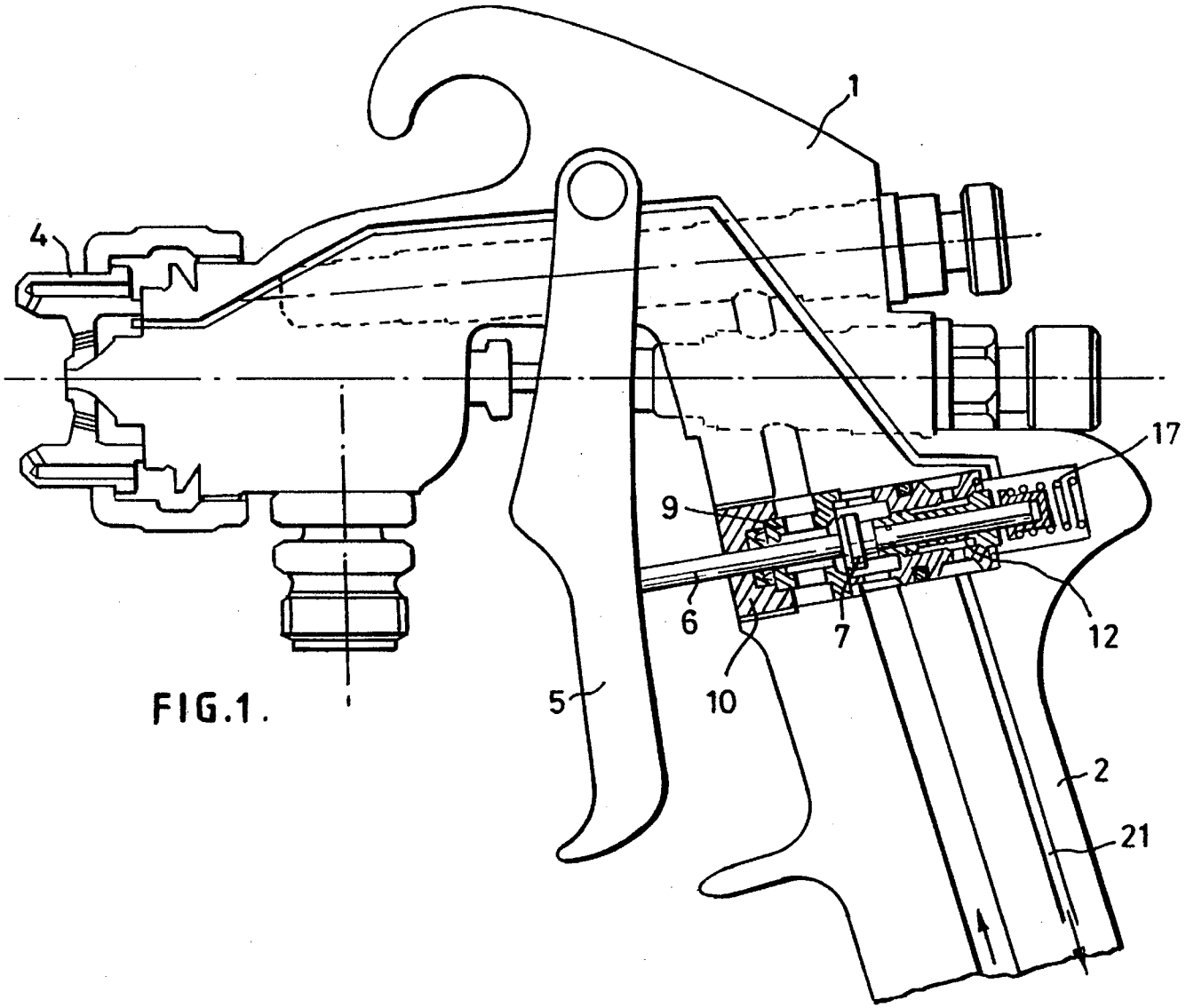

Preferably, the spindle is returned to its closed position by a spring engaging the valve spindle. An embodiment of an air valve according to the invention will now be described by way of example only, with reference to the accompanying drawings, in which:

FIG. 1 is a cross-sectional elevation of a spray gun fitted with an air valve; and FIGS. 2 to 5 are diagrammatic cross-sections of the air valve shown in FIG. 1 in different operational positions.

The spray gun shown in FIG. 1 comprises a main body 1, a handle 2 and an air cap 4. The paint is fed from a reservoir under the control of a regulator (not shown).

The air valve illustrated controls the feedback air sensed at the gun air cap 4 and is operated by the gun's trigger 5.

Figure 2:
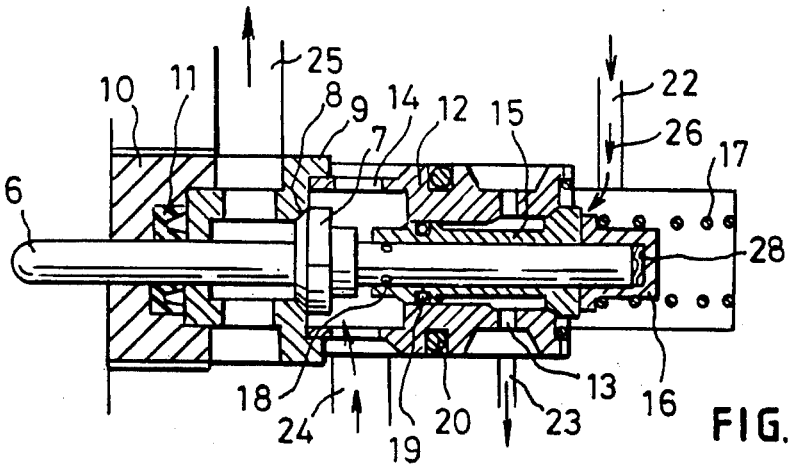

FIG. 2 illustrates the air valve in the off position with an operating spindle 6 in a released or forward position with its shoulder 7 engaging a first seating 8 of a stationary valve member 9. The spindle 6 passes through a hole in member 9 and an air valve body 10 with the interposition of a rubber or resilient plastics seal 11.

The valve member 9 is aligned with a valve spool 12 with annular ports 13 and 14. Sliding in the valve spool is a slidable shuttle 15 one end of which engages the rear of the spindle shoulder 7 and its other end is engageable with a cup 16 spring loaded by a spring 17 in the gun body 1.

A second seating **12*a* on valve spool 12 cooperates with a shoulder 15*a* on the shuttle 15 to provide a closeable passage between the inlet port 22 and the outlet port 23. The shuttle 15 and valve spool 12 are sealed between one another by O-ring seals 18 and 19 respectively and the shuttle 15 is sealed in the body 1 of the spray gun by an O-ring seal 20**.

The feedback line is connected to the end of the spray gun handle 2 via pipe 21 which is connected to the air valve at port 23. The air pressure fed back from the air cap 4 is connected to the air valve at port 22. The main air enters the air valve at the main inlet 24 and leaves the air valve at the main port 25 to the atomising/spreader air circuit.

Figure 3:
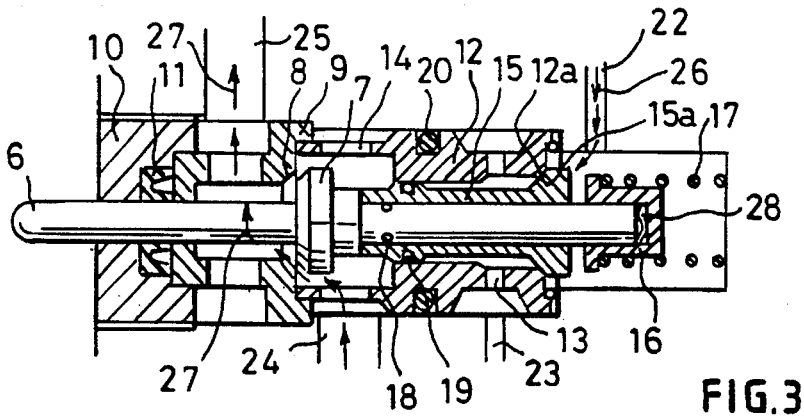
Figure 4:
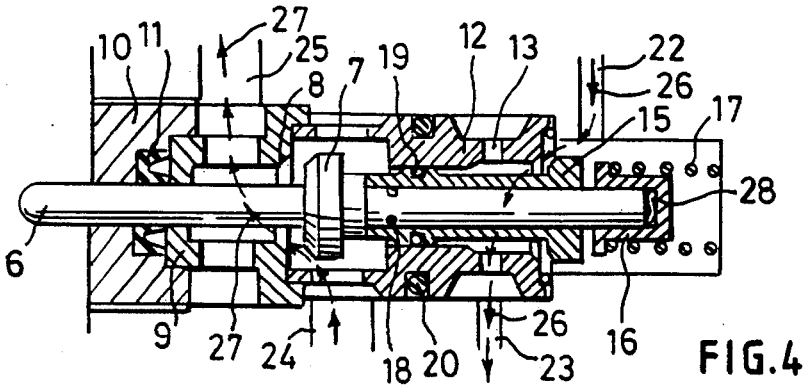
Figure 5:
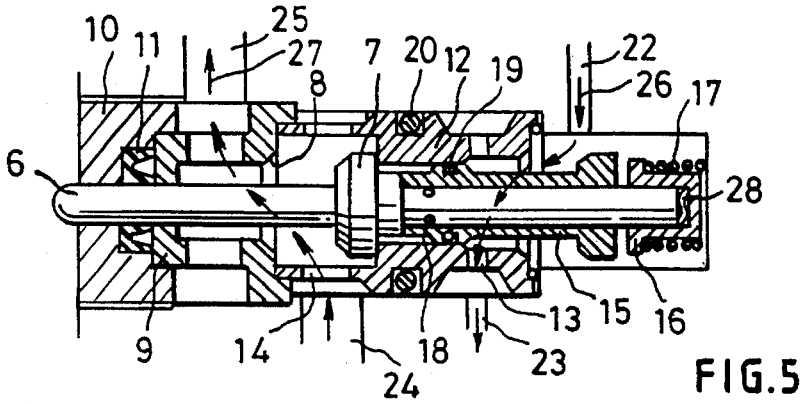

FIGS. 3 to 5 illustrate three operational positions of the trigger 5 from a slight pressure on the trigger to its fully depressed position.

It will be appreciated that the smooth operation of the trigger 5 will control the flow of the main air to the air cap 4 based on the pressure of the feedback air sensed at the gun air cap to maintain a fixed air pressure e.g. 10 psi (0.7 bar) at the air cap.

Applying a slight pressure to the trigger 5 causes a rearward movement of the operating spindle 6 opening the first seating 8 by rearward movement of the spindle shoulder 7. This allows air to pass from the main inlet 24 to the main port 25 (See FIG. 3). Further pressure on the trigger 5 moves the operating spindle 6 so that the shuttle 15 is engaged by the rear of the spindle shoulder 7.

Full pressure on the trigger 5 moves the operating spindle 6 rearwards until shoulder 7 contacts an abutment on the valve spool 12 and at the same time moves the shuttle 15 rearwards to open the second seating **12*a* compressing spring 17 via a wave-shaped spring 28 located in the cup 16, allowing air from the feedback line 22 to pass to outlet port 23** and control the output of the air regulator to which it connected.

In the reverse sequence, a slight removal of pressure from the trigger 5 allows operating spindle 6 to move forwards under the action of the spring 17 acting on the cup 16 and transmitting its thrust through the wave-shaped spring 28 contained within the cup 16. Further removal of pressure on the trigger 5 allows further forwards nmovement of operating spindle 6 until the cup 16 contacts the rearward face of shuttle 15 under the action of spring 17 and closes the second seating **15*a* interrupting the flow of air through the inlet 22. Removal of all the pressure on the trigger 5 allows full forwards movement of operating spindle 6 until shoulder 7 contacts the first seating 8 under the action of the wave-shaped spring 28, closing the main port 25 preventing flow of air to the aircap 4**.

The air in the aircap 4 escapes to the atmosphere as does the air in the feedback line 26 by the reverse flow. The feedback air contained between the closed second seating **15*a* and the feedback regulator is maintained at the desired pressure at the aircap 4, e.g. 10 p.s.i. (0.7 bar) and causes the feedback regulator to remain at the setting necessary to feed the main air to the inlet 24 at the correct pressure to supply air to the aircap at the desired pressure when next the trigger 5** is pulled.

We claim:

1. An air valve for controlling the feedback air in spray guns comprising a valve body (10) and a fixed valve member (9), a spindle (6) slidable and sealingly passing through the valve body (10) and valve member (9), the spindle (6) having a shoulder (7) engaging and closing a first seating (8) in the valve member (9), the rear of the spindle (6) slidable in a shuttle (15) which is itself slidable in a fixed valve spool (12), the spool having a second seating (**12*a*) closed by the rear of the shuttle (15), characterized in that two ports (22, 23) are provided one at either side of the second seating (12*a*) between the spool (12) and shuttle (15) for the passage of feedback air past the valve and two further ports (24, 25) are provided at either side of the first seating (8) between the valve member (9) and spindle shoulder (7) for the passage of main air through the valve so that operation of the spindle (6**) opens the first seating prior to the second seating and closes the second seating prior to the first seating.

2. An air valve as claimed in claim 1, characterized in that the spindle (6) is returned to its closed position by a spring (17) which bears on a cup (16) engaging the valve spindle.

3. An air valve as claimed in claim 1, characterized in that the shuttle (15) is sealed by an O-ring seal (18) between the spindle (6) and shuttle (15) against the passage of air past the seal (18).

4. An air valve as claimed in claim 1, characterized in that the shuttle (15) is sealed by an O-ring seal (19) between the shuttle (15) and valve spool (12) against the passage of air past the seal (19).

5. An air valve as claimed in any of claims 1 to 4, characterized in that the valve spool (12) is sealed in the body (1) of a spray gun by an O-ring seal (20) against the passage of air past the seal (20).

6. An air valve as claimed in claim 2, characterized in that one end of the spring (17) is held by the cup (16) and the other end of the spring engages the body (1) of a spray gun, the spring cup (16) engaging the shuttle to close the seating between the spool and shuttle (15).

7. An air valve as claimed in any of claims 1 to 4 and 6, wherein a resilient seal (11) is located in a recess in the valve body (10) to surround and seal the passage of air past the spindle (6).

8. An air valve as claimed in claim 5, characterized in that one end of the spring (17) is held by the cup (16) and the other end of the spring engages the body (1) of a spray gun, the spring cup (16) engaging the shuttle to close the seating between the spool and shuttle (15).

9. An air valve as claimed in claim 5, wherein a resilient seal (11) is located in a recess in the valve body (10) to surround and seal the passage of air past the spindle (6).

* * * * *